US009095019B2

(12) United States Patent
Chen et al.

(10) Patent No.: US 9,095,019 B2
(45) Date of Patent: Jul. 28, 2015

(54) CIRCUIT AND METHOD FOR CURRENT-BASED ANALOG DIMMING OF LIGHT EMITTING DIODE ILLUMINATORS, WITH IMPROVED PERFORMANCE AT LOW CURRENT LEVELS

(71) Applicant: DiCon Fiberoptics Inc., Richmond, CA (US)

(72) Inventors: Kuan-Po Chen, Kaohsiung (TW); Ho-Shang Lee, El Sobrante, CA (US)

(73) Assignee: DiCon Fiberoptics, Inc., Richmond, CA (US)

( * ) Notice: Subject to any disclaimer, the term of this patent is extended or adjusted under 35 U.S.C. 154(b) by 36 days.

(21) Appl. No.: 14/173,729

(22) Filed: Feb. 5, 2014

(65) Prior Publication Data

US 2014/0361694 A1 Dec. 11, 2014

Related U.S. Application Data

(60) Provisional application No. 61/832,664, filed on Jun. 7, 2013.

(51) Int. Cl.
*H05B 37/02* (2006.01)
*H05B 33/08* (2006.01)

(52) U.S. Cl.
CPC ..... *H05B 33/0806* (2013.01)

(58) Field of Classification Search
CPC ..... H05B 33/0842; H05B 33/0836; H05B 33/083; H05B 33/0806; H05B 33/0821; H05B 33/0818; Y02B 20/345; Y02B 20/347; Y02B 20/343; Y02B 20/346; Y02B 20/341
USPC ..... 315/185 R, 291, 294, 307, 312, 247, 224
See application file for complete search history.

(56) References Cited

U.S. PATENT DOCUMENTS

| | | | | |
|---|---|---|---|---|
| 8,120,277 | B2 * | 2/2012 | McKinney | 315/294 |
| 8,742,695 | B2 * | 6/2014 | Wray | 315/307 |
| 2011/0068701 | A1 * | 3/2011 | van de Ven et al. | 315/185 R |

* cited by examiner

*Primary Examiner* — Haissa Philogene
(74) *Attorney, Agent, or Firm* — Davis Wright Tremaine LLP

(57) ABSTRACT

By diverting a small amount of current from a string of LED(s) powered by a LED driver at low current levels in a process of dimming the LED string, performance of the LED string light emission is improved.

26 Claims, 7 Drawing Sheets

CIRCUIT AND METHOD FOR CURRENT-BASED ANALOG DIMMING OF LIGHT EMITTING DIODE ILLUMINATORS, WITH IMPROVED PERFORMANCE AT LOW CURRENT LEVELS

CROSS-REFERENCE OF PATENT APPLICATION

This application claims priority from U.S. Provisional Application No. 61/832,664, filed Jun. 7, 2013, which application is incorporated herein in its entirety by this reference.

BACKGROUND

This invention relates to a circuit design and associated method for implementing current-based analog dimming of Light Emitting Diode (LED) illuminators, and in particular to a circuit design and method that improves the performance and accuracy of the dimming function, at low levels of current through the LED devices.

One of the basic required functions of the control circuits for LED illuminators is the ability to control the dimming or brightness of the LEDs. In most LED illuminator designs, direct current (DC) is fed through individual LED devices, or strings of LED devices, causing them to emit light. There are two basic methods of controlling the brightness of the LED devices, or dimming them. One of these basic methods is to vary the level of the direct current that is fed through the LED devices, with the brightness level of the LED illuminator being roughly proportional to the level of current. This method will henceforth be referred to as either current-based dimming, or analog dimming. The other basic method is to use a fixed current amplitude, and then to interrupt the flow of current at some frequency and duty cycle. This latter method is typically referred to as Pulse-Width Modulation (PWM) dimming. Because the human eye can integrate or average the pulses of emitted light, the perceived brightness of an LED illuminator that uses PWM dimming is basically proportional to the duty cycle of the pulsed LED current.

The two basic methods of dimming have different advantages and disadvantages. Generally speaking, PWM dimming is viewed as providing well-controlled and repeatable dimming, since the perceived brightness is tightly correlated with the duty cycle of the PWM signal, and it is fairly straightforward to generate a consistent and repeatable PWM signal. The primary disadvantage of PWM dimming is due to its very nature, and is related to the fact that the LEDs are being turned rapidly on and off. Although this is usually not a problem for human vision, it can cause problems with photography, videography, and some machine-vision applications that require the light source or illuminator to be ON at all times, without pulsing.

Although current-based analog dimming solves the fundamental issues associated with PWM dimming, by virtue of providing a constant current to the LEDs (i.e., without pulsing), there are other problems associated with this method. The most fundamental issue is that the light output of LED devices is only approximately proportional to the current flowing in them, with diminishing efficiency as the current increases, and as the junction temperature of the LED devices increases. However, it is possible to compensate for this non-linear behavior by calibrating the level of current provided, for different intended brightness levels. Other sources of inaccuracy in the current-controlled, analog dimming method are introduced by the use of commercially-available LED driver control chips or integrated circuits (ICs). The present invention provides a circuit and method that addresses one of the common limitations of commercially-available LED driver ICs, by offering current-controlled analog dimming with improved performance at low current levels and low brightness levels.

Commercially-available prior art LED driver ICs typically provide a regulated constant-current feed to one or more LEDs, that are typically connected as a series string to ensure that the same current is flowing in all of the LEDs. Current regulation is provided through the use of a low-value current-sensing resistor, wired in series with the LED or LED string. The small voltage drop across this resistor is fed back to the LED driver IC, as a representation of the current flowing through the LED(s), and the LED driver IC uses this signal to regulate the current being sourced to the LED(s).

Most such prior art LED driver ICs provide for both PWM dimming, and current-controlled analog dimming. A typical method for providing current-controlled analog dimming is to provide an input pin on the LED driver IC, to which a small control voltage is applied, such that the resulting regulated LED current will be proportional to the applied control voltage. Typically, the allowed range of control voltages that can be applied to this pin is quite small, falling well within the range of 0 to 5 volts, and more typically between 0 and 2 volts. This is so the LED driver IC can be powered by a low voltage power supply, and also so that the control voltage can be generated by a low voltage control circuit. In a typical prior art LED driver IC, a control voltage of approximately 0.2 volts (or less) will result in a minimum LED current, ideally 0 mA, and a control voltage that is greater than or equal to approximately 1.2 volts will result in maximum LED current. Control voltages between 0.2 volts and 1.2 volts result in a proportional, or linearly-scaled LED current. The exact range of intended control voltage will depend, of course, on the specific LED driver IC that is selected. The control voltage itself may be generated and controlled in a variety of ways, including the use of potentiometer or other resistive voltage divider circuit, or by a processor sending digital codes to a commercially-available Digital-Analog Converter (DAC) device. It should also be noted that some commercially-available LED driver ICs allow the user to feed a digital PWM signal into the LED driver IC as a control input, and have the capability of internally interpreting the PWM signal as an analog dimming control input, thereby effectively "converting" a PWM dimming signal to current-based, analog dimming.

Commercially-available prior art LED driver ICs typically provide fairly accurate LED current, as a function of the control voltage input, for LED currents that range from 100% of the designed maximum LED current, down to approximately 5% or 10% of the designed maximum current. However, at low LED current levels, that are less than approximately 5% or 10% of the designed maximum LED current, many LED driver ICs experience difficulty in properly regulating the current value. This manifests itself as either an inability to fully turn the LEDs off, or, alternatively, as an inability to dim fully, thereby preventing reliable achievement of low brightness levels. In the latter case, the symptom is that the LEDs will simply turn off when the selected current level is less than 5% or even 10% of the maximum current.

SUMMARY OF THE INVENTION

This invention is based on the recognition that the root cause of this behavior is that the current regulation function of typical commercially-available LED driver ICs does not accurately regulate currents that are less than 10 or perhaps even 20 mA, for a typical high-brightness LED application.

The present invention solves this problem by creating a "dummy load" on the LED driver circuit, in such a way that the LED driver circuit is supplying the LED string with a current that is sufficiently high to ensure accurate current regulation. The present invention therefore comprises a circuit and method for providing current-controlled analog dimming of LED illuminators, with improved performance at low current levels, leading to improved dimming at low brightness levels.

One embodiment of the invention is directed to an apparatus for driving an LED string that includes one or more LEDs, comprising a drive circuit that supplies a current, in response to a control signal applied to the drive circuit, to the LED string, to cause the LED string to emit light. The current supplied by the drive circuit to the LED string is a non-linear function of a control signal parameter within a first range of the control signal parameter value, and a linear function of the control signal parameter within a second range of the control signal parameter value. The apparatus also includes a dummy load circuit in parallel with the LED string. The dummy load circuit diverts current supplied by the drive circuit to the LED string when the value of the control signal parameter applied to the drive circuit is in the first range, so that substantially no current is supplied by the drive circuit to the LED string when the control signal value is within the first range.

One more embodiment of the invention is directed to a method for driving a LED string that includes one or more LEDs, comprising supplying to the LED string a current, in response to a control signal, to cause the LED string to emit light. The current supplied by the drive circuit is a non-linear function of a control signal parameter within a first range of the control signal parameter value, and a linear function of the control signal parameter within a second range of the control signal parameter value The method further comprises diverting the current supplied to the LED string by means of a dummy load circuit arranged in parallel with the LED string when the value of the control signal parameter applied to the drive circuit is in the first range, so that substantially no current is supplied to the LED string when the control signal parameter value is within the first range.

DETAILED DESCRIPTIONS OF THE PREFERRED EMBODIMENTS

Figure 1:
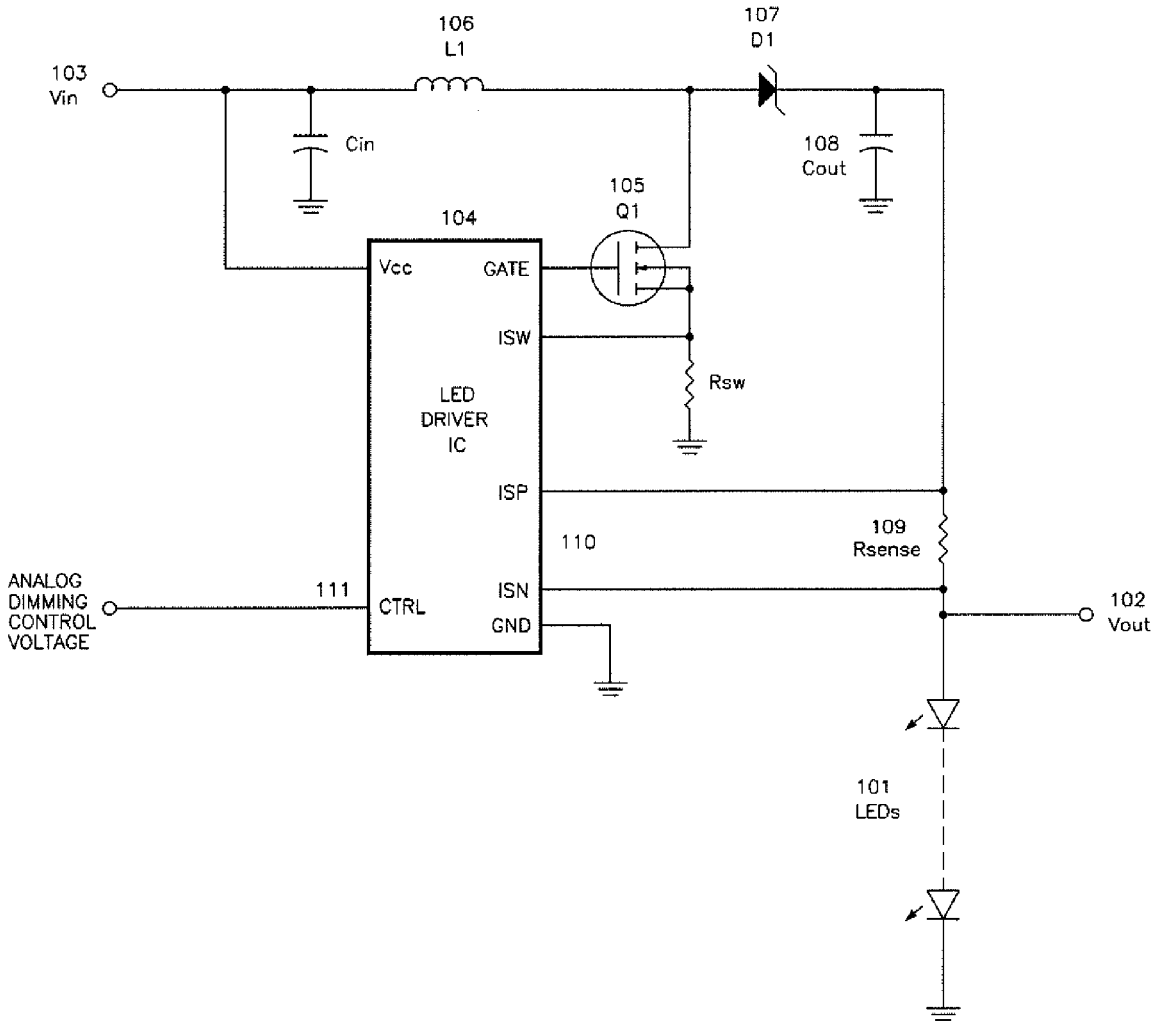
FIG. 1 (PRIOR ART)
FIG. 1 is a representation of a typical prior art LED light source or illuminator, comprised of LED devices that are connected as a series string, and a representative LED driver circuit.

FIG. 1 illustrates a representative prior art LED illuminator design, with a string of LEDs (101) being driven by an LED driver circuit that is designed to provide a regulated, constant current. The LEDs (101) are connected in series, to ensure that the current is identical in each of the LED devices. The constant-current design is relatively insensitive to the number of LEDs in the string, as long as the total voltage drop across the string is lower the designed maximum output voltage of the driver circuit.

The prior art LED driver circuit shown in FIG. 1 is configured as a boost converter, in which the output voltage Vout (102) is intended to be a higher voltage than the input voltage Vin (103). LED driver circuits may also be configured as buck converter, with Vout designed to be a lower voltage than Vin, or as a buck-boost converter, in which Vout may be either higher or lower than Vin. One skilled in the art of LED driver circuit design will understand that the circuit and method of the present invention is applicable to many configurations of the driver circuit, including boost, buck, and buck-boost regulators. The specific LED driver circuit shown in FIG. 1 is therefore intended to be representative of multiple prior art LED driver circuit configurations. Many commercially available prior art LED driver ICs are designed to be used in boost, buck, or buck-boost configurations, with different configurations of the external components.

As stated above, the prior art LED driver circuit of FIG. 1 is configured as a boost regulator, in which the input voltage Vin (103) is boosted to create an output voltage Vout (102). The boost in voltage is controlled by LED driver IC 104, by controlling the switching of MOSFET Q1 (105), using a typical boost regulator design that incorporates an inductor L1 (106), a diode D1 (107), and an output capacitor Cout (108). Feedback is used to regulate and control the switching of Q1 (105). In order to achieve a regulated, constant current, the voltage across a sense resistor, Rsense (109) is fed to the driver IC (104) via pins ISP and ISN (110). This voltage is proportional to the current flowing in the LED string, and the driver IC (104) regulates the switching of Q1 (105) to maintain a designed constant current level. Vout (102) may therefore vary, depending on the number of LED devices in the LED string, and on their total forward voltage drop when driven with the designed constant current. The value of Rsense (109) is therefore precisely chosen to result in the desired constant current value for the LED string (101), at maximum brightness (without dimming).

In the prior art LED driver circuit of FIG. 1, current-based analog dimming is provided by supplying a control voltage to the CTRL pin (111) of the LED driver IC (104). Varying the voltage applied to the CTRL pin (111) results in a reduction of the current through the LED string (101), reducing the current from the maximum current value that is established or set by the value of Rsense (109). The range of control voltages required at the CTRL pin (111) is a function of the specific driver IC used. In the discussion that follows, the assumption is that a voltage of less than 0.2 volts at the CTRL pin (111) is intended to result in no current through the LED string, and that a voltage at the CTRL pin (111) that is greater than or equal to 1.2 volts is intended to result in maximum current through the LED string, as determined by Rsense. Voltages between 0.2 volts and 1.2 volts at the CTRL pin (111) are therefore intended to linearly scale the current from 0 mA to $I_{MAX}$. While this range of analog dimming control voltages is fairly typical for commercially-available LED driver ICs, different LED driver ICs may specify or require different analog dimming control voltage ranges. For that matter, the control input signal for some LED driver ICs may be something completely different than a small voltage. In principle, the control input for an LED driver IC's analog dimming control could be one of any number of signal types, including a voltage, a current, or a digital input signal of some kind. However, in the discussion that follows, it will be assumed that the analog dimming control input is a small voltage.

Figure 2:
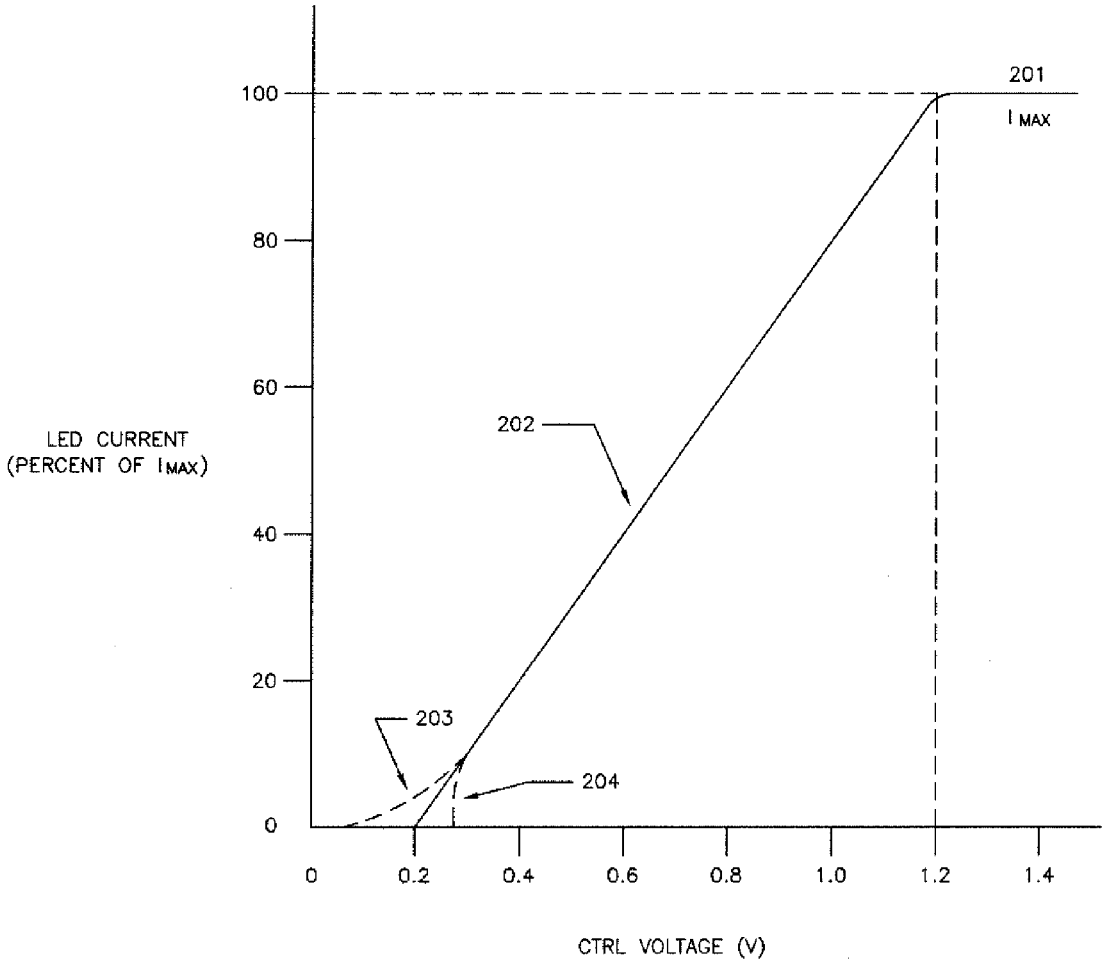
FIG. 2 PRIOR ART
FIG. 2 is a representation of the current that is provided by a representative embodiment of a commercially-available prior art LED driver IC, as a function of a control voltage input.

FIG. 2 shows a plot of LED current provided by the prior art LED driver circuit of FIG. 1, as a function of the applied control voltage at the CTRL pin. The vertical scale is shown as a percentage of the designed or intended maximum LED current, $I_{MAX}$ (201). As stated above, the horizontal scale is intended to be representative of a typical LED driver IC that uses a small voltage as the control input for its analog dimming function, and in that sense the numeric values and units of the horizontal scale are arbitrarily chosen. Ideally, the LED current should scale linearly with the voltage applied at CTRL, as shown in the solid-line plot (202). However, commercially available prior art LED driver ICs tend to have difficulty in maintaining linear behavior when dimming to low LED current levels, with LED currents that are lower than roughly 5% (or even 10% in some cases) of the designed maximum current $I_{MAX}$. The reasons for this non-linearity at low current levels depend on the specific LED driver IC that is used, but the fundamental reasons are that 1) at low current levels the switching of the regulator circuit is at lower and lower duty cycles, and therefore the finite switching time of the switching transistor or MOSFET device Q1 (105) introduces larger variation in the total ON time of the switching device, and 2) the inherent accuracy of the comparator circuitry that senses the analog dimming control voltage CTRL (111) is less at the low end of CTRL's voltage range.

Although different LED driver IC designs exhibit varying degrees of accuracy and linearity problems at low current levels, the basic issue applies to almost all commercially available LED drive ICs. Some commercially available LED driver ICs exhibit the behavior shown in FIG. 2 by dashed line 203, in which the LED current isn't completely reduced to zero when the CTRL voltage is set to 0.2 volts. This will result in the LED illuminator remaining partly lit when it is intended to be shut off. Other commercially available LED driver ICs exhibit the behavior shown in FIG. 2 by dashed line 204, in which the LED current drops to zero at a voltage that is higher than the intended turn off point of 0.2 volts. This will result in the LED illuminator shutting off abruptly, or too soon, as it is dimmed, and may also result in an inability to set the brightness level of the illuminator at very low levels.

Figure 3:
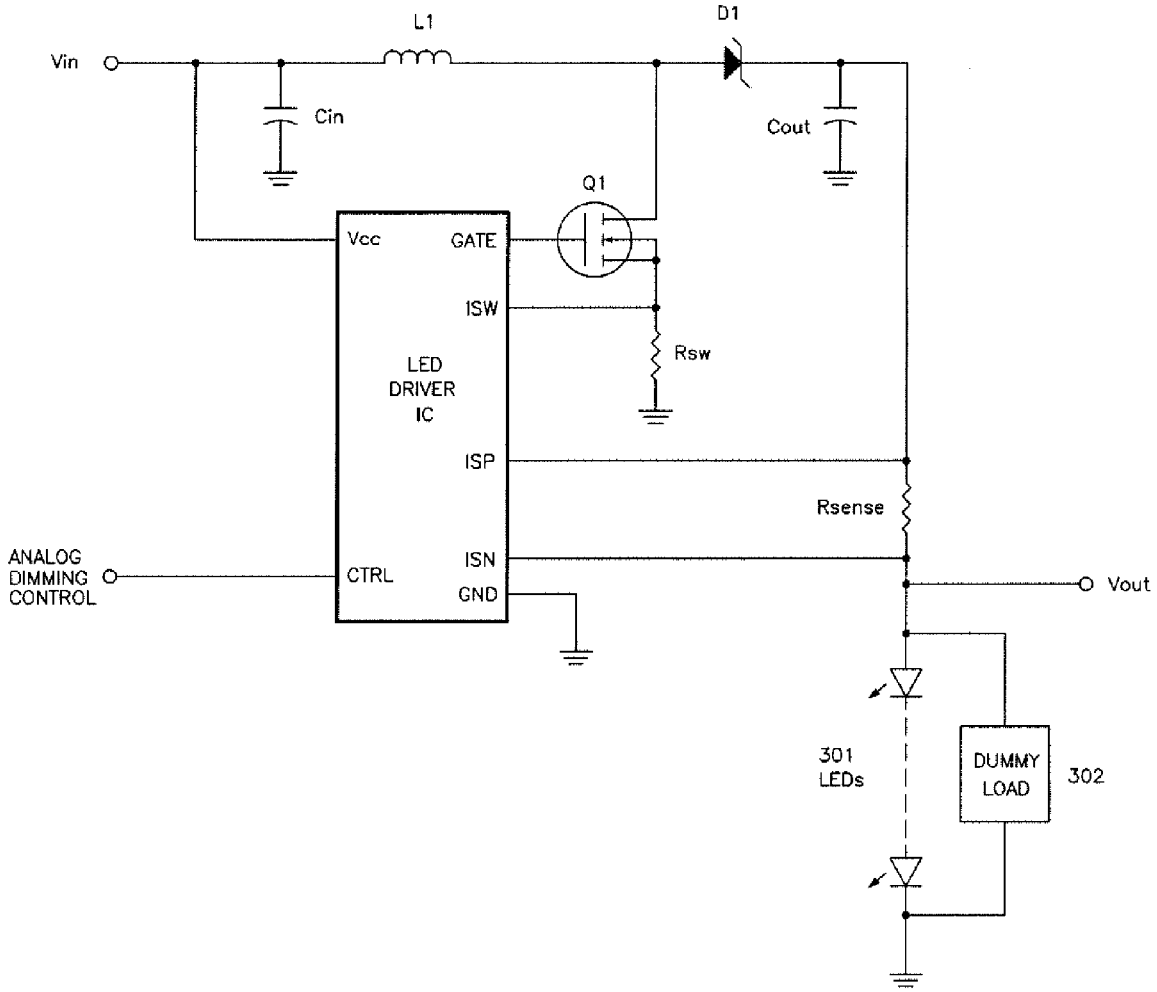
FIG. 3 is a representation of one embodiment of the present invention, implementing a fixed-current dummy load.

The method and concept behind the present invention is shown in FIG. 3. The LED driver circuit shown in FIG. 3 is mostly the same as the prior art LED driver circuit shown in FIG. 1. The present invention comprises the addition of a "dummy load" element (302), in parallel with the LED string (301). Note that the circuit and method of the present invention are applicable to other configurations of LED driver circuits, regardless of whether they are configured as boost regulators, buck regulators, or buck-boost regulators. In all cases, the dummy load element (302) is connected in parallel with the LED string (301), regardless of how the LED string is connected to the LED driver circuit, and regardless of whether one end of the LED string is directly grounded or not. In all cases, it is important that the current flowing in the current-sense resistor, Rsense, is the combined current that flows in both the LED string, and in the dummy load element. The basic concept of the present invention is that the dummy load is designed to act as a constant current load, with small current value (roughly 5% or less of the designed maximum current $I_{MAX}$, through the LED string). In other words, the constant current drawn by the constant current load is preferably not more than about 5% of the designed maximum current $I_{MAX}$, For example, if $I_{MAX}$ is intended to be 500 mA, the constant current dummy load might be set to 20 mA, or even as low as 10 mA. For a given LED driver circuit implementation, the dummy load current would be set somewhat higher than the value at which the dimming function begins to behave in a non-linear fashion. By "pre-loading" the LED driver circuit at the low-current end of its dimming range, the intent is to have the actual current through the LED string behave linearly in response to the signal (e.g. voltage) supplied at the CTRL pin. The resulting dimming profile is discussed in more detail, below.

Figure 4:
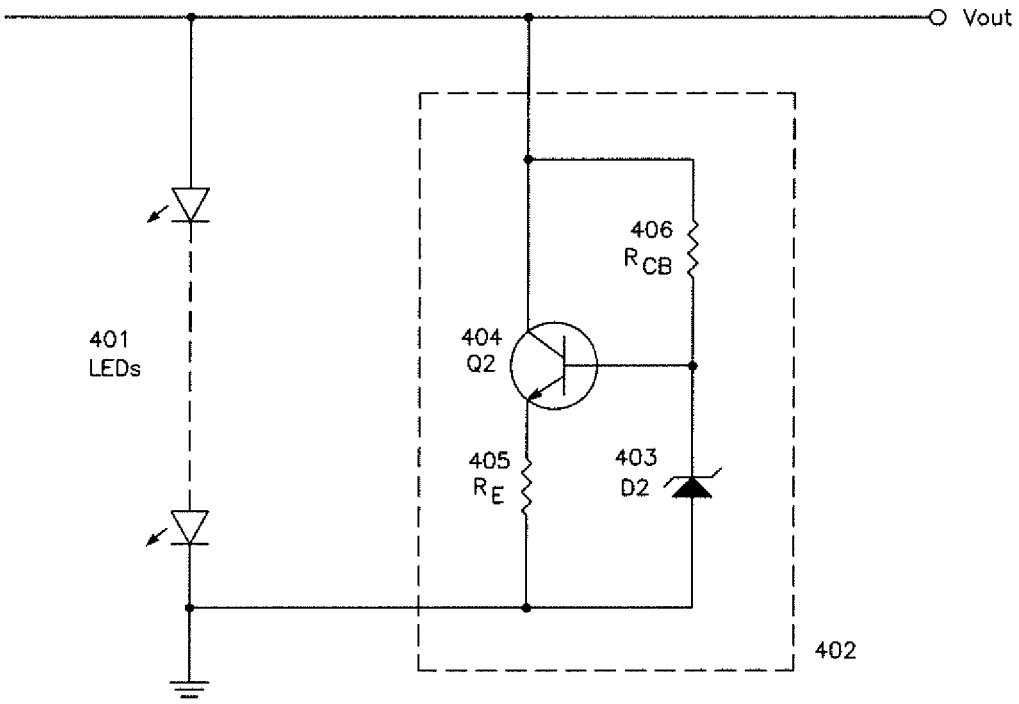
FIG. 4 is a representation of a dummy load circuit implementation, for one embodiment of the present invention.

FIG. 4 shows one embodiment of the present invention, comprising a circuit (402, shown within the dashed lines) that provides a constant current dummy load for an LED string (401). The rest of the LED driver circuit is not shown. The constant current load $I_L$ provided by this circuit is determined primarily by zener diode D2 (403), the base-emitter voltage drop $V_{BE}$ of NPN transistor Q2 (404), and the value of emitter resistor $R_E$ (405), using the approximate formula: $I_L \approx (V_{ZENER}-V_{BE})/R_E$. Or, alternatively, $R_E \approx (V_{ZENER}-V_{BE})/I_L$. This formula assumes that the reverse voltage drop across zener diode D2 (403) is essentially a constant, and the gain of the NPN transistor (404) is set sufficiently high such that the currents flowing through $R_{CB}$ (406) and zener diode D2 (403) are quite small in comparison to the current flowing through $R_E$ (405). Using assumed values of 5.7 volts for $V_{ZENER}$, and 0.7 volts for the $V_{BE}$ of a typical NPN silicon transistor, one can see that a desired IL of 10 mA is achieved by setting $R_E$ to 500 ohms.

The selection of zener diode D2 (403) and its reverse breakdown voltage $V_{ZENER}$ are somewhat flexible, but are dependent on the number of LEDs that will be in the LED string (401). $V_{ZENER}$ is chosen such that it is sufficiently less than the minimum total string voltage at which the LEDs will begin to conduct current, and illuminate. Put another way, the dummy load circuit should be drawing its designed current before any appreciable current begins to flow in the LED string. For this reason, the circuit shown in FIG. 4 is generally not applicable to the driving of a single LED, and is therefore intended primarily for applications in which series strings of two or more LEDs are being driven.

The choice of resistance value for $R_{CB}$ is also quite flexible. In general, $R_{CB}$ (406) will have a resistance value that is much higher than that of $R_E$ (405). It is desirable for $R_{CB}$ to have a high value, such that the current that flows through zener diode D2 (403) is very small (i.e., orders of magnitude smaller) in comparison to the current flowing through $R_E$ (405). However, $R_{CB}$ must be low enough such that it provides sufficient current to the base of Q2 (404), to keep Q2 turned on. Thus, the minimum gain specification of Q2 establishes an upper bound for the value of $R_{CB}$.

In another embodiment of the dummy load circuit, it is possible to replace zener diode D2 (403), with a resistor, having a resistance value similar to that of $R_{CB}$ (406). Referring to FIG. 4, in this additional embodiment the symbol representing zener diode D2 (403) would be replaced with a resistor symbol at the same location, which will be referred to in the subsequent discussion as R2. In this additional embodiment, the dummy load current value becomes a function of the voltage across the LED string (401), and the voltage divider represented by $R_{CB}$ (406) and the resistor R2 that replaces D2. Assuming that the gain of the NPN transistor Q2 (404) is high, then the voltage across R2 (which we can refer to as V2) is given by $V2 \approx V_{OUT} \cdot R2/(R2+R_{CB})$. Then $I_L \neq (V2-V_{BE})/R_E$. This alternate embodiment can be used when the number of LEDs in the string is known, and therefore the voltage across the LED string is reasonably constant. However, since the voltage across the LED string is still somewhat dependent on the LED current, the dummy load current drawn by this embodiment will also be somewhat dependent on the LED current, and not quite constant, especially at very low LED currents.

Figure 5:
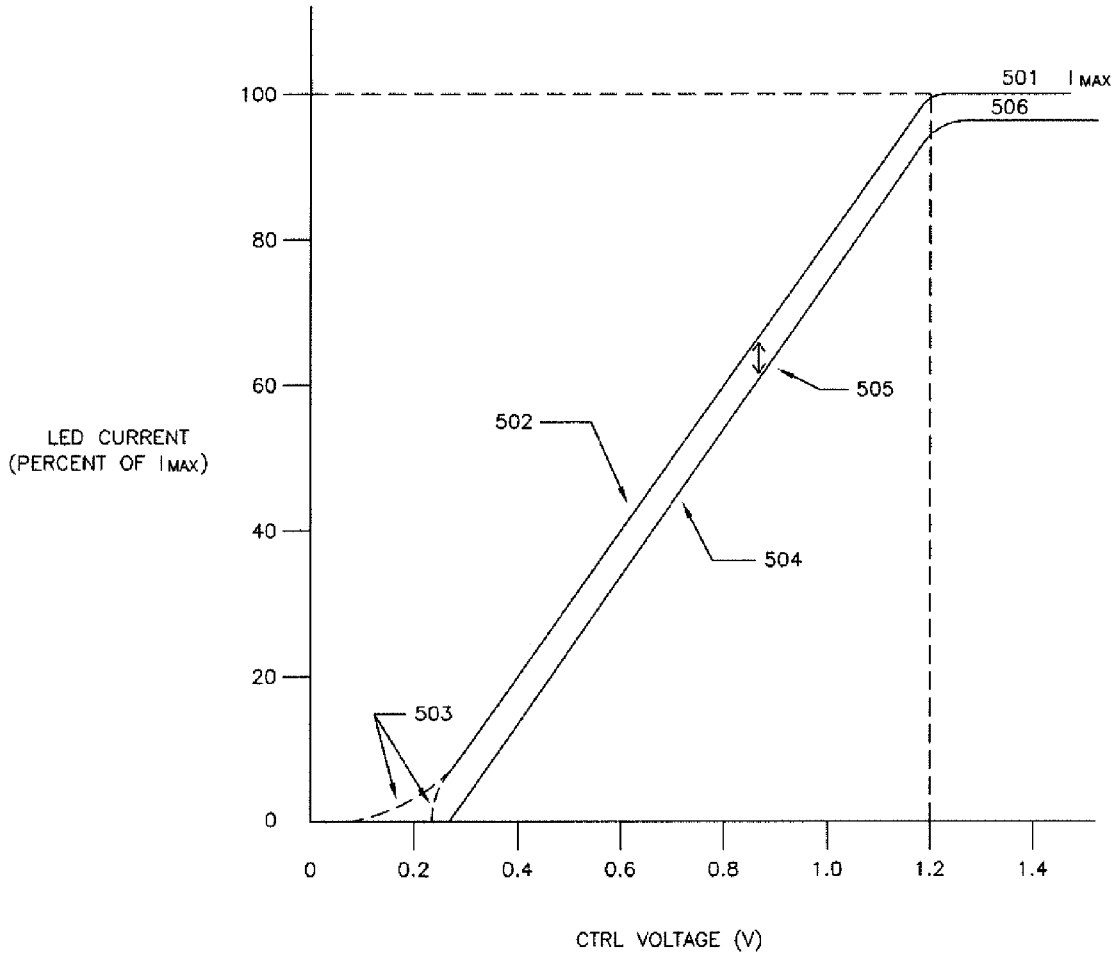
FIG. 5 is a representation of the current that is provided by one embodiment of the present invention, as a function of a control voltage input.

FIG. 5 illustrates the effects of the present invention on the current-control analog dimming function of a representative LED driver circuit. The upper plot (502) represents the total current being provided by the LED driver circuit, expressed as a percentage of $I_{MAX}$ (501), and plotted as a function of the analog dimming control voltage CTRL, that is being provided to the LED driver IC. Plot 502 is identical to the plot shown in FIG. 2, and shows the same sort of potential non-linear behavior at low current levels as is depicted in FIG. 2. This non-linear behavior is depicted in FIG. 5 by the dashed, curved lines (503) in the low-current portion of plot 502. By drawing a small, fixed or constant current, the dummy load provided by the present invention results in the actual current through the LED string being reduced by this fixed amount, at all values of the analog dimming control voltage CTRL. This results in the actual LED current shown as plot 504, which remains a linear function of the CTRL voltage down to essentially zero LED current. Note that the amount of current difference (505) between plot 502 and plot 504 remains constant, over essentially the full range of the control voltage CTRL. The point at which current begins to flow in the LED string (the intercept of plot 504 with the horizontal axis) is now at a CTRL voltage value that is slightly higher than 0.2 volts. It is also true that the constant-current dummy load serves to reduce the maximum current that actually flows through the LEDs, for CTRL values greater than 1.2 volts (as shown by item 506). Looked at another way, if a particular maximum current value is intended for the LED string, then $I_{MAX}$ for the LED driver circuit is set slightly higher, to account for the constant-current dummy load.

The dummy load current value is set so that it is above the current value at which the total LED driver circuit's current profile becomes linear (in other words, at a current level that is above the dashed, curved lines (503) shown in FIG. 5). As the analog dimming control voltage CTRL is raised from its nominal OFF voltage of 0.2 volts, current will flow first into the dummy load, with essentially no current flowing in the actual LED string. Once the current being provided by the LED driver circuit begins to exceed the designed constant current of the dummy load circuit (at a CTRL voltage that is somewhat higher than 0.2 volts), then current will begin to flow in the actual LED string. Further increases to the CTRL voltage result in linear or proportional increases to the LED string current, while the dummy load current $I_L$ remains fixed at its set value 505 (as shown in the plots in FIG. 5). Based on the set dummy load current value, the CTRL voltage at which the linearized LED current begins to flow can be determined.

The constant-current dummy load circuit embodiment shown in FIG. 4 has one disadvantage, in that it consumes power over the entire dimming range of the LED driver circuit. The approximate power dissipation of the circuit shown in FIG. 4 is $I_L$ (the constant current that flows in the dummy load circuit)×$V_{LED}$ (the total voltage drop of the LED string, also labeled as Vout in FIG. 4). If the dummy load current $I_L$ was sized to be 5% of $I_{MAX}$, then the power dissipation in the dummy load circuit will be 5% of the power dissipation in the actual LED string. This represents a non-trivial penalty to the efficiency of the overall LED driver circuit.

What makes this power dissipation and efficiency penalty more unfortunate is that the dummy load current is only needed at low LED driver current levels. At higher LED driver current levels, the driver circuit becomes sufficiently linear, and there is no need to waste power in the dummy load circuit. What is desired is a dummy load circuit that draws its designed value of current at low LED or LED driver currents, and then draws less current (or shuts off completely) once the LED current or LED driver current is sufficiently high to behave linearly.

Figure 6:
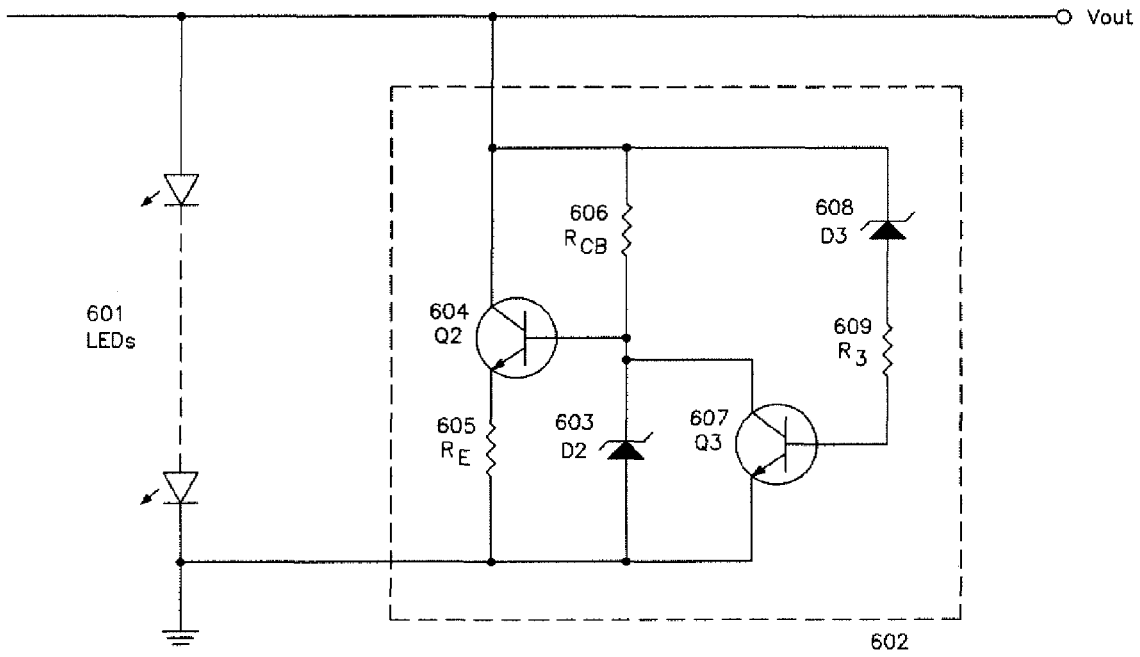
FIG. 6 is a representation of a second embodiment of the present invention, implementing an adaptive dummy load.

FIG. 6 shows another embodiment of the dummy load circuit (602) of the present invention, with an improved current profile. This circuit is intended to draw a fixed current at low LED or LED driver currents, and then to draw a reduced current once the current in the LEDs is sufficiently large for the LED driver circuit to provide good linearity. The embodiment shown in FIG. 6 uses the voltage across the LED string (Vout) to serve as an indicator of the current flow through the LEDs (601). NPN transistor Q2 (604), zener diode D2 (603), and resistors $R_E$ (605) and $R_{CB}$ (606) implement a constant-current load, identical to the embodiment shown in FIG. 4. The added NPN transistor Q3 (607) is used to gradually pull current through $R_{CB}$ (606), starving the base current of Q2 (604). This causes the constant current or dummy load current to be gradually reduced. The reduction in the dummy load current begins once Vout reaches or slightly exceeds ($V_{D3}$+$V_{BE3}$), where $V_{D3}$ is the voltage across zener diode D3 (608). $V_{BE3}$ is the base-emitter voltage of Q3 (607), and is approximately 0.7 volts for a silicon transistor. The value of resistor R3 controls how rapidly the dummy load current is reduced, as Vout exceeds ($V_{D3}$+$V_{BE3}$).

Figure 7:
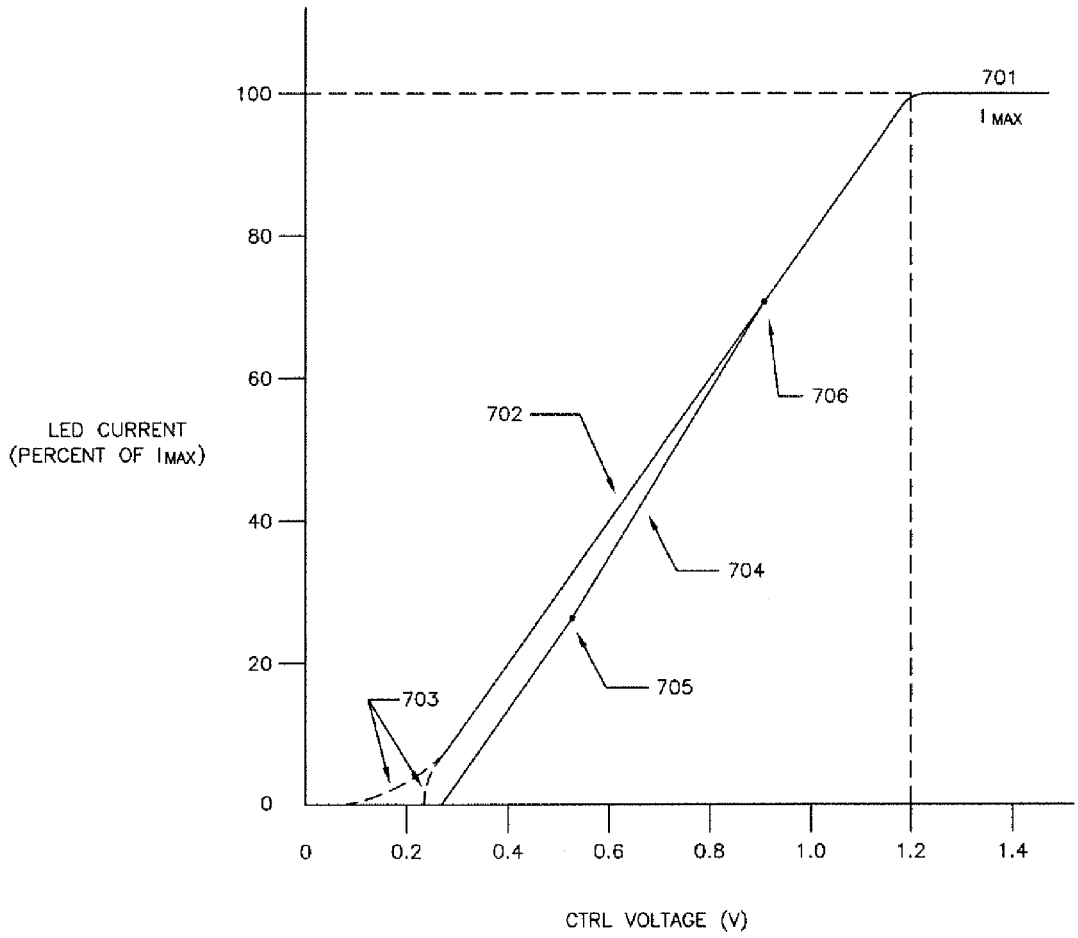
FIG. 7 is a representation of the current that is provided by a second embodiment the present invention, as a function of a control voltage input.

FIG. 7 shows the current versus voltage plots for the improved dummy load circuit of FIG. 6. The upper plot (702) in FIG. 7 is identical to the upper plot (502) of FIG. 5, and represents the total current provided by the LED driver circuit, with maximum value IMAX (701) occurring with a CTRL voltage that is greater than or equal to 1.2 volts. As in FIG. 5, the total current provided by the LED driver circuit may exhibit non-linearities at low current levels, as shown by the dashed, curved lines (703). The lower plot (704) represents the actual current flowing through the LED string. Therefore, the difference between upper plot 702 and lower plot 704 represents the current flowing through the improved dummy load circuit of FIG. 6.

At low LED string current levels, up to the point along the lower plot that is indicated by label 705, the improved dummy load circuit provides a small constant-current load. Then, as the current in the LED string increases, and as the voltage across the LED string increases, the current in the improved dummy load circuit is reduced, and the lower plot begins to converge to the upper plot. At some higher LED string current (indicated by label 706), the current flowing in the improved dummy load circuit has been reduced to zero, and from this point all of the current being provided by the LED driver circuit is flowing through the LED string (and so the upper and lower plots of FIG. 7 are converged). Note that the maximum current flowing in the LED string is therefore $I_{MAX}$ (701), the maximum current output of the LED driver circuit. Further, at high current levels, there is no additional power dissipation in the improved dummy load circuit, and therefore no efficiency penalty at high current levels.

The LED string current level at which the improved dummy load circuit begins to reduce its current (705) is determined primarily by the breakdown voltage of zener diode D3, as described above. The range of LED string current over which the improved dummy load circuit reduces its current to zero (the portion of plot 704 between points 705 and 706) is controlled primarily by the value chosen for resistor R3, as well as the gain of transistor Q3. Ideally, point 705 would be placed at a low LED string current value (for example, at 10% of $I_{MAX}$), whereas point 706 would ideally be placed fairly close to $I_{MAX}$. This would result in an overall LED string current profile that is reasonably linear across a broad range of current values.

One limitation of the improved dummy load circuit shown in FIG. 6 is that it is using the voltage across the LED string as a proxy or representation of the LED string current. However, the voltage across the LED string varies less than proportionally, as a function of the LED string current. In other words, a large variation in LED string current results in a relatively modest variation in the LED string voltage. This makes it somewhat difficult to place the "inflection points" of plot 704 (i.e., points 705 and 706), with a high degree of accuracy. Further, the proper component values for zener diode D3 (608) and R3 (609) depend on the number of LEDs in the LED string, as well as on the individual LEDs' voltage/current properties. In an additional embodiment of an improved dummy load circuit, the circuit directly senses the actual current flowing through the LED string (or, alternatively, the total LED driver current), and uses this indication to control the ramping down of the dummy load current, as the LED string current increases. Since it is typical for LED driver circuits to use a current sense resistor as part of the current regulation circuitry (for example, Rsense in FIGS. 1 and 3), one skilled in the art of electronic circuit design could use this voltage to control the ramping down of the dummy load current. Further, since the voltage across Rsense is already used by typical commercially-available LED driver ICs, another embodiment of the present invention incorporates a redesigned LED driver IC that uses the voltage across Rsense to provide a control signal for the dummy load circuit.

While the invention has been described above by reference to various embodiments, it will be understood that changes and modifications may be made without departing from the scope of the invention, which is to be defined only by the appended claims and their equivalents.

The invention claimed is:

1. An apparatus for driving a LED string that includes one or more LEDs, comprising:

a drive circuit that supplies a current, in response to a control signal applied to the drive circuit, to the LED string to cause the LED string to emit light, wherein the current supplied by the drive circuit is a non-linear function of a control signal parameter within a first range of the control signal parameter value, and a linear function of the control signal parameter within a second range of the control signal parameter value; and a dummy load circuit in parallel with the LED string, said dummy load circuit diverting current supplied by said drive circuit to the LED string when the value of the control signal parameter applied to the drive circuit is in the first range, so that substantially no current is supplied by the drive circuit to the LED string when the control signal parameter value is within the first range.

2. The apparatus of claim 1, wherein the current diverted by said dummy load circuit is substantially constant.

3. The apparatus of claim 1, wherein the current diverted by said dummy load circuit is substantially constant when the control signal parameter value is within the first range, and decreases when the control signal parameter value is increased within the second range.

4. The apparatus of claim 1, wherein the current diverted by said dummy load circuit is substantially constant when the control signal parameter value is within the first and second ranges.

5. The apparatus of claim 1, wherein the current diverted by said dummy load circuit is not more than about 5% of a maximum current provided by the drive circuit to the LED string.

6. The apparatus of claim 1, wherein the dummy load circuit includes a Zener diode that is connected to the base of a transistor, configured such that the current diverted by said dummy load circuit is substantially proportional to the difference in voltage between the reverse breakdown voltage of the Zener diode, and the base-emitter junction voltage of the transistor.

7. The apparatus of claim 6, wherein a reverse voltage drop across the Zener diode is less than a minimum electrical potential difference across the LED string at which the LED string will begin to conduct current and emit light.

8. The apparatus of claim 1, wherein the dummy load circuit includes a first circuit path and a second circuit path parallel to one another, said first circuit path including a transistor and the second circuit path including circuit elements controlling a voltage applied to the transistor.

9. The apparatus of claim 8, wherein the second circuit path includes one or more Zener diodes.

10. The apparatus of claim 8, wherein the second circuit path includes a voltage divider circuit.

11. The apparatus of claim 8, wherein the second circuit path includes a voltage divider circuit comprising two resistors.

12. The apparatus of claim 8, wherein the dummy load circuit includes a third circuit that reduces the voltage applied to the transistor when the control signal parameter value increases and is in the second range.

13. The apparatus of claim 12, wherein the third circuit reduces the voltage applied to the transistor when the control signal parameter value increases, at a rate such that the current applied to the LED string is substantially a linear function of the control signal parameter value, and such that the current diverted by the dummy load circuit is reduced as the control signal parameter value increases.

14. A method for driving a LED string that includes one or more LEDs, comprising:

supplying to the LED string a current, in response to a control signal, to cause the LED string to emit light, wherein the current supplied by the drive circuit is a non-linear function of a control signal parameter within a first range of the control signal parameter value, and a linear function of the control signal parameter within a second range of the control signal parameter value; and diverting the current supplied to the LED string by means of a dummy load circuit arranged in parallel with the LED string when the value of the control signal parameter applied to the drive circuit is in the first range, so that substantially no current is supplied to the LED string when the control signal parameter value is within the first range.

15. The method of claim 14, wherein the current diverted by said dummy load circuit is substantially constant.

16. The method of claim 14, wherein the current diverted by said dummy load circuit is substantially constant when the control signal parameter value is within the first range, and decreases when the control signal parameter value is increased within the second range.

17. The method of claim 14, wherein the current diverted by said dummy load circuit is substantially constant when the control signal parameter value is within the first and second ranges.

18. The method of claim 14, wherein the current diverted by said dummy load circuit is not more than about 5% of a maximum current provided to the LED string.

19. The method of claim 14, wherein the dummy load circuit includes a Zener diode that is connected to the base of a transistor, wherein said dummy load circuit is configured such that the current diverted by said dummy load circuit is approximately proportional to the difference in voltage between the reverse breakdown voltage of the Zener diode, and the base-emitter junction voltage of the transistor.

20. The method of claim 19, wherein a reverse voltage drop across the Zener diode is less than a minimum electrical potential difference across the LED string at which the LED string will begin to conduct current and emit light.

21. The method of claim 14, wherein the dummy load circuit includes a first circuit path that comprises a transistor, said method further including controlling a voltage applied to the transistor.

22. The method of claim 21, wherein the controlling of the voltage is performed by means of one or more Zener diodes.

23. The method of claim 21, wherein the controlling of the voltage is performed by means of a voltage divider circuit.

24. The method of claim 21, wherein the controlling of the voltage is performed by means of a voltage divider circuit comprising two resistors.

25. The method of claim 21, further comprising reducing the voltage applied to the transistor when the control signal parameter value increases and is in the second range.

26. The method of claim 25, wherein the voltage applied to the transistor is reduced when the control signal parameter value increases at a rate such that the current applied to the LED string is substantially a linear function of the control signal parameter value, and such that the current diverted by the dummy load circuit is reduced as the control signal parameter value increases.

* * * * *